United States Patent [19]

Bottolfson

[11] Patent Number: 4,498,211

[45] Date of Patent: Feb. 12, 1985

[54] RETRACTABLE BRUSH

[75] Inventor: Gary Bottolfson, Rapid City, S. Dak.

[73] Assignee: Michael O'Connor, Vermillion, S. Dak. ; a part interest

[21] Appl. No.: 577,615

[22] Filed: Feb. 6, 1984

[51] Int. Cl.[3] ..... A46B 9/10

[52] U.S. Cl. ..... 15/203

[58] Field of Search ..... 15/203, 201; 132/119, 132/120, 121, 122, 123, 129

[56] References Cited

U.S. PATENT DOCUMENTS

| | | | |
|---|---|---|---|
| 1,189,698 | 7/1916 | Keating | 15/203 |
| 2,981,965 | 5/1961 | Kaye et al. | 15/203 |
| 4,103,387 | 8/1978 | Anetseder, Jr. et al. | 15/203 |
| 4,121,314 | 10/1978 | Nathe | 15/203 |

*Primary Examiner*—Peter Feldman

*Attorney, Agent, or Firm*—Lowe, King, Price & Becker

[57] ABSTRACT

A folding brush comprises a case having parallel first and second walls respectively having first and second interior faces spaced from each other to form a cavity. The first wall includes a matrix of cylindrical like slots extending between the first face and a third face on the exterior of the first wall. A frame slides along a longitudinal axis in the cavity between a first retracted, locked position and a second fully extended, locked position. Multiple of tapered, unifilar, generally straight bristle tufts have bases mounted in the frame so longitudinal axes of the tufts rotate together from a first retracted angle displaced slightly from the frame longitudinal axis to a second fully extended angle approximately at right angles to the frame longitudinal axis in response to the frame sliding between the first and second longitudinal positions. The first angle, the geometry of the slots, the lengths of the tufts and the spacing between the first and third faces are such that when the bristles are in the retracted position a region on each tuft bears against an intersection between the first face and the slot in which the element is located so the region is cammed by the intersection to maintain the tufts in situ in the slot so the tip of the tuft is in the slot with no portion of the tip extending beyond the third face.

16 Claims, 15 Drawing Figures

RETRACTABLE BRUSH

FIELD OF INVENTION

The present invention relates generally to brushes having matrices of folding brush tufts and more particularly to such brushes wherein the bristle tufts are folded, while not in use, so that no ends thereof are exposed and the tufts are held in situ, to prevent fraying.

BACKGROUND ART

Many different folding hairbrushes particularly designed to be unobtrusively stowed in a pocket or the like of a user have been proposed. None of the proposed folding brushes have, to my knowledge, been produced on a large scale basis. The proposed folding brushes have probably not been sold on a large scale basis because, inter alia, the problems associated with such brushes have not seemingly been studied with sufficient care.

The typical prior art folding brush has included a case having parallel first and second walls respectively having first and second interior faces spaced from each other to form a cavity. The first wall includes a matrix of cylindrical slots extending between the first face and a third face on the exterior of the first wall. A frame is slid along a longitudinal axis in the cavity between first and second longitudinal positions where the frame is locked. Multiple bristle tufts, each having a longitudinal axis, are mounted on the frame. As the frame slides between the first and second longitudinal positions, the longitudinal axes of the tufts rotate together from a first angle displaced from the frame longitudinal axis to a second angle approximately at right angles to the longitudinal axis.

In one proposed structure, the bristle tufts are positioned on the frame and the matrix of slots is arranged so each of the bristle tufts is in a separate one of the slots. The matrix is arranged so that the bristle tufts in adjacent rows are displaced to be in offset columns, such that the bristle tufts in alternate rows are in aligned columns and vice versa. In other words, the bristle tufts in even numbered rows are in aligned columns, while the bristle tufts in odd numbered rows are in aligned columns different from the bristle tufts in even numbered rows. Such a configuration enables the bristle tufts to be packed compactly in such a manner as to preclude interference between each other as the tufts are rotated so they extend from and are retracted in the case.

In analyzing the prior art brushes having folding bristle tuft matrices, I have found that several problems are extant. The bristles have a tendency to become frayed if any bristle in a particular tuft or if a unifilar element forming a bristle tuft extends beyond the third face, i.e., outside of the slot in which it is located, while the frame is in the retracted position. Fraying of the bristles has a tendency to enlarge the diameter of a particular tuft. My experiments have revealed that such enlargement must be avoided because such bristles have a tendency to catch on the slot when the bristle tufts are driven between the retracted and expanded position, i.e., from the first angle to the second angle. Catching of one bristle in a particular tuft or a single unifilar element forming a tuft may prevent rotation of the bristles or tufts or of the entire bristle matrix. Catching of the bristles causes additional fraying, causing the entire process to become regenerative. A frayed tuft is ineffective and can have deleterious effects on the hair of a user. It is also desirable to prevent the tips of the bristles from protruding beyond the case to enable the structure to have a neat appearance, and to be smooth to the touch. In addition, if the bristles protrude beyond the case, the bristles have a tendency to tangle with objects in places where the brush is stored, for example, a pocketbook, pocket, suitcase, wash kit, glove compartment, etc.

It is, accordingly, an object of the present invention to provide a new and improved folding brush.

Another object of the present invention is to provide a new and improved folding brush having bristle tufts arranged so that no bristles extend outside of slots in which the tufts are located while the bristles are in a retracted position in a case therefor.

An additional object of the invention is to provide a new and improved folding brush wherein the tendency of bristles in the brush to fray while the bristles are in a retracted position is avoided.

Still an additional object of the invention is to provide a new and improved folding brush wherein bristle tufts are held in place in slots while the brush is in a retracted, inoperative position, and a casing for the brush has a relatively small volume so that the brush can be stowed unobtrusively while not in use.

DISCLOSURE OF INVENTION

In accordance with the present invention, a folding brush of the type described supra is modified so that when the bristles are in a retracted position a region on each bristle bears against an intersection between the first face and the slot in which the bristle is located so the region is cammed by the intersection to be maintained in situ in the slot so the tip of the element is in the slot with no portion of the tip extending beyond the third face. Preferably, the invention is utilized in brushes wherein each of the multiple bristle tufts is formed by a tapered, unifilar, generally straight element having a tip, base and longitudinal axis. The unifilar element has a smaller cross sectional area at the tip thereof than at the base thereof. Each element is cammed by its corresponding intersection such that all segments of the element between the region and the tip are displaced from walls of the slot. Thereby, tufts having a tapered tip and a generally spherical enlarged element at the tip can be employed in identically configured slots. Because the retracted tufts are displaced from the slot, except at the point of intersection between the slot and the first face, the tuft assembly is more easily rotated from the retracted to the extended position.

To assist in maintaining the bristle tips in situ between the first and third faces so that the tips do not extend beyond the third face, the region of each bristle cammed by the intersection faces toward the third face and is cammed by the intersection away from the third face toward the second face.

As a result of an analysis I have conducted as to the proper geometry of the relationship between the slots and bristles, I have found that the optimum range for the angle between the longitudinal axis of the bristles and the first and third faces is between 13° and 20°, preferably 15°. It is preferable for the edges of the slots closest and farthest away from a pivot point for the bristles, while the bristles are in the retracted position, to be respectively displaced 5° less than and 5° greater than the bristle longitudinal axis from the first face.

If the longitudinal axis of the bristles relative to the first face is less than approximately 13°, individual bristles in one row have a tendency to contact bars carrying bristles in an adjacent row while the brush is retracted. If such contact occurs, bristle bars carrying the bristles bear against the second wall, to tend to bind the bars and prevent rotation of the bars and the bristle tufts when the brush is changed from the retracted to the extended position. While the binding problem can be avoided by increasing the spacing between adjacent bristle bars, the increased spacing deleteriously reduces the density of the bristle tufts and therefore the effectiveness of the brush while in use. The reduced bristle tuft density decreases the effectiveness of the brush for grooming purposes. In addition, an angle less than 13° results in a structure which is difficult to manufacture, particularly to mold out of plastic, as required for high production relatively inexpensive brushes.

Increasing the angle of the longitudinal axis of the bristles beyond 20° relative to the first face has the deleterious effect of making the brush excessively thick, so that it is not easily stowed, particularly in a pocket book or handbag of a user. The optimum 15° angle provides a folding brush having a minimum overall volume, with optimum bristle density.

A further feature of the invention is the structure for locking the tufts in the retracted and extended position while providing stable movement of the frame, and smooth, unhindered rotation of the bristles between these two positions. The tuft locking mechanism includes a tongue fixedly attached to the frame and longitudinally translated in a second cavity communicating with the cavity containing the frame. A first face of the tongue carries a detent bar which engages notches in the second cavity; the notches are at positions corresponding with the retracted and extended positions. A foot extending from a second face of the tongue opposite from the first face contacts a first face of the cavity while the tongue is stationary and translating to assist in providing stability while the frame is at rest and moving. The tongue is made of a relatively flexible spring like material to enable the detent bar to be pushed out of the notches and be urged against a second face of the cavity opposite to the first cavity face when the tongue is translating between the notches.

It is, accordingly, an additional object of the invention to provide a new and improved structure for locking tufts of a folding brush in retracted and extended positions, while permitting stable movement of a frame carrying the tufts, as well as smooth, unhindered rotation of the bristles between the retracted and extended positions.

To provide a more positive mechanism for assuring that the frame is in the retracted position, a stop is provided for the frame. The stop is located in the handle and is formed by an exterior surface of a hollow post. The post has a longitudinal passage for receiving a tether strap, such as a leather string. A tether strap is desirable for certain users to assist in handling the brush. The positive stop prevents the frame and the bristles from being excessively withdrawn into the case. If the frame were inadvertently moved beyond the post as the bristles are retracted, the bristles would slide out of the slots, and thereby ruin the brush. The post forming the stop provides a synergistic result since it can also be used to hold a tether strap.

A further feature of the device is that the case is formed of two halves which are securely locked together by gluing a tongue and groove together. The tongue and groove extend completely around the perimeter of the two halves. The tongue and groove function as an alignment mechanism when the brush is assembled. The tongue provides a separation between the two halves so that if there is a very slight misalignment between the two halves, it is not noticed by a user. If the two halves abutted against each other, instead of being slightly separated, a slight misalignment could be discerned by many users who would feel that the brush was poorly constructed and poorly molded. The misalignment can be as small as 1 to 2 mils. Such misalignment is not noticed if the top and bottom halves are spaced from each other at the perimeter edges thereof.

A further object of the present invention is to provide a new and improved folding brush having a positive stop for a frame carrying rotatable bristles.

Another object of the invention is to provide a new and improved folding brush having a positive stop that also functions to hold a tether strap.

An additional object of the invention is to provide a folding brush which is fabricated of two similar, molded plastic halves which are positively locked together by a mechanism that also prevents slight misalignment of the two halves to be imperceptible to the touch.

The above and still further objects, features and advantages of the present invention will become apparent upon consideration of the following detailed description of several specific embodiments thereof, especially when taken in conjunction with the accompanying drawings.

BRIEF DESCRIPTION OF THE DRAWING

FIG. 6 is a side sectional view of a portion of the bristle segment of the brush illustrated in FIG. 1 while the bristles are in a fully retracted position;

BEST MODE FOR CARRYING OUT THE INVENTION

Figure 1:
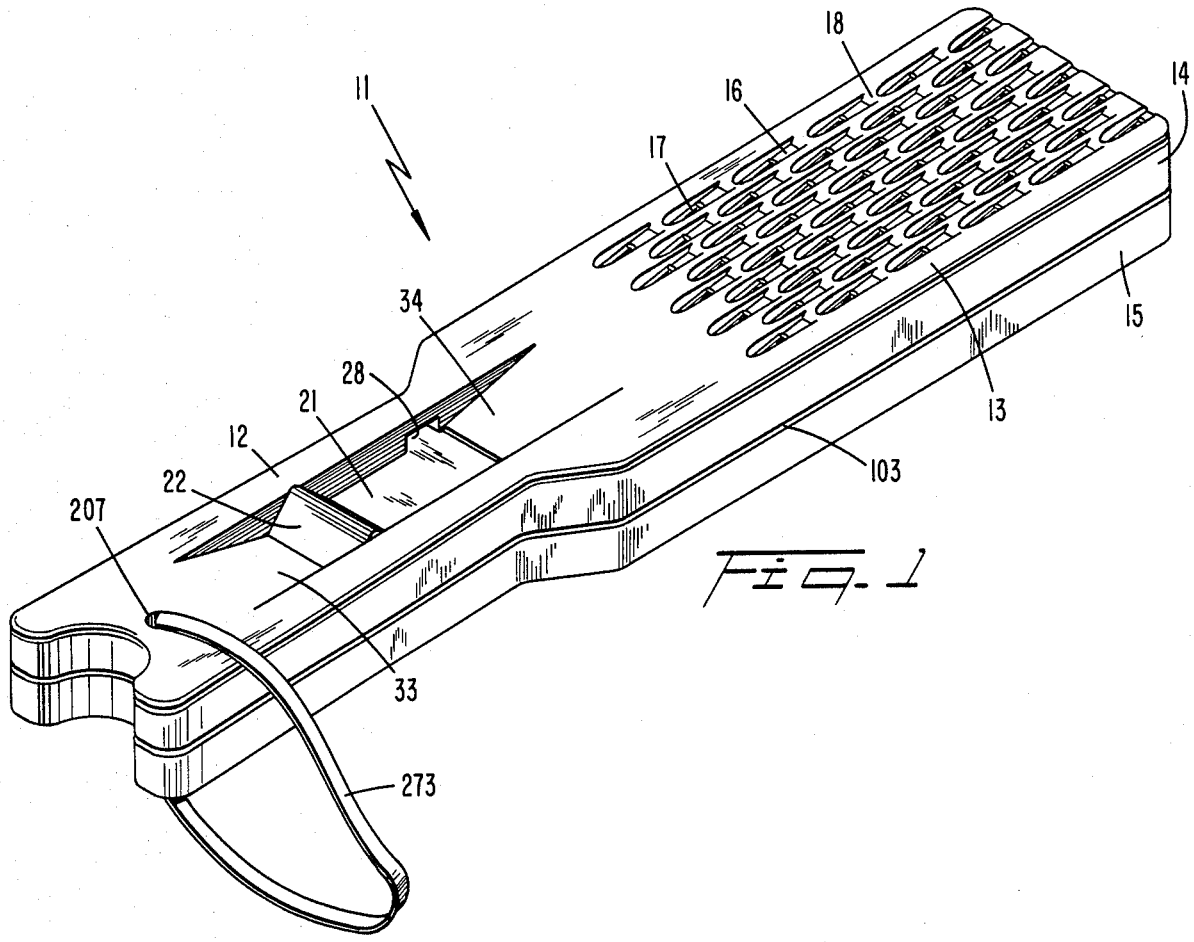
FIG. 1 is a perspective view of a folding brush in a retracted position, in accordance with one embodiment of the present invention.
Figure 12:
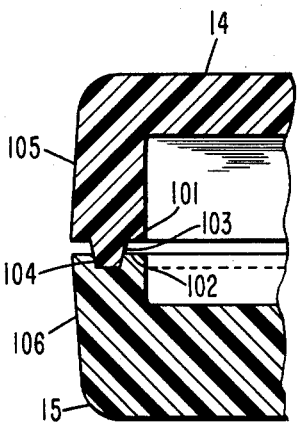
FIG. 12 is a side sectional view of the top and bottom cover halves of the casing, in combination with a tongue and groove for securing the two casing halves together.

Reference is now made to FIG. 1 of the drawing wherein there is illustrated a folding hair brush of the type that is usually inserted into a pocket or pocketbook and which includes an elongated case 11 including handle 12 and bristle segment 13; handle 12 and bristle segment 13 are at opposite ends of casing 11. Case 11 includes two generally parallel, preferably plastic halves 14 and 15, having adjacent interior faces bonded to each other. As illustrated in FIG. 12, top and bottom cover halves 14 and 15 respectively include parallel, facing faces 101 and 102. Tongue 103 extends downwardly from face 101 into groove 104, in face 102. Faces 101 and 102, as well as tongue 103 and groove 104 respectively extend around the entire perimeter of top and bottom case halves 14 and 15. Tongue 103 is bonded into groove 104 by any suitable means, such as epoxy glue or by fusing. There is approximately a 15 mil separation between faces 101 and 102 so that if there is slight misalignment (such as 1 or 2 mils) between side walls 105 and 106 of top and bottom cover halves 14 and 15, such misalignment is not noticed.

Figure 9:
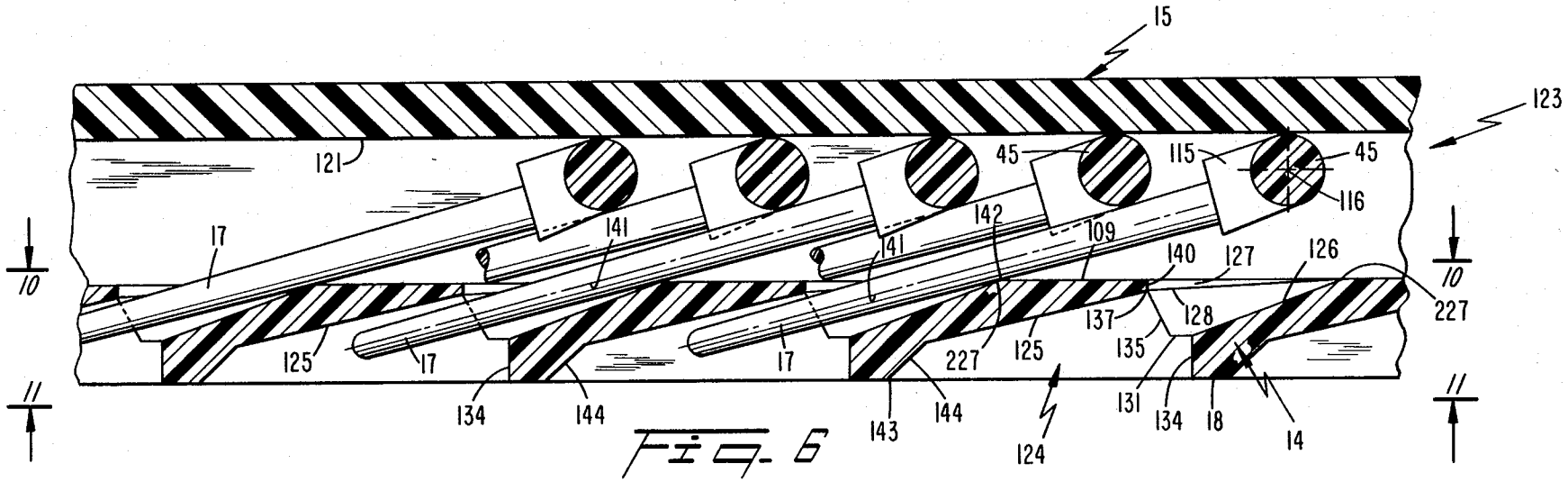
FIG. 9 is a view similar to FIG. 6 of a second embodiment of the invention wherein the bristles have enlarged spheres at the end thereof.
Figure 10:
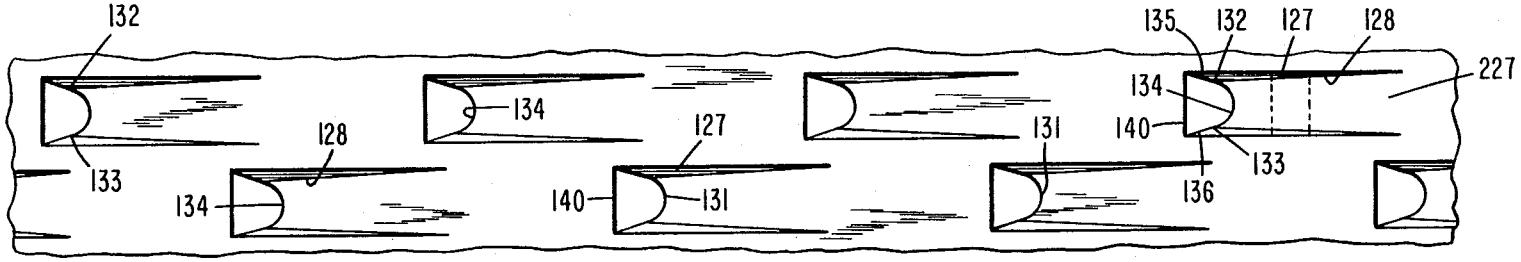
FIG. 10 is a plan view of several rows and columns of slots as viewed from the interior of the case illustrated in FIG. 6.
Figure 11:
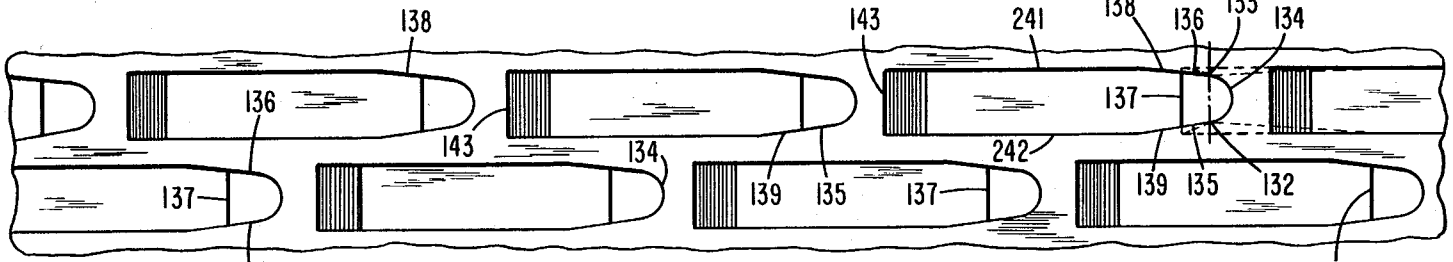
FIG. 11 is a plan view of several rows and columns of slots as viewed from the exterior of the case illustrated in FIG. 6.

In bristle segment 13, top cover half 14 includes slot matrix 16 through which tapered, unifilar generally straight bristle tufts 17 extend. Each bristle tuft in the preferred embodiment includes only a single such unifilar element. In one embodiment, as illustrated in detail in FIG. 6, the tip of each bristle element 17 is rounded such that there is a smooth transition from the tapered perimeter of the element to the rounded portion. In a second embodiment, as illustrated in FIG. 9, the tip of each bristle tuft 17 is enlarged to form sphere 107 having a diameter appreciably greater than the diameter of the bristle element in proximity to the tip. When brush 11 is not in use and bristle tuft elements 17 of either embodiment are in a retracted position, the bristle tufts are located completely in individual slots of matrix 16. While the brush is in use bristle tufts 17 are rotated so they extend at right angles to exterior face 18 of casing half 14.

The slots of matrix 16 are arranged on exterior face 18 in rows and columns such that the slots of adjacent rows are in columns displaced from each other. The center lines of all slots in even numbered rows are aligned in a first set of columns, while the center lines of odd numbered rows are aligned in a second set of columns, with the sets of columns being equally displaced from each other. The odd numbered rows have five slots, while the even numbered rows have four slots. The center lines of all slots in a particular row are equally displaced from each other and are on a perpendicular bisector of the slot center lines of the adjacent row.

Figure 2:
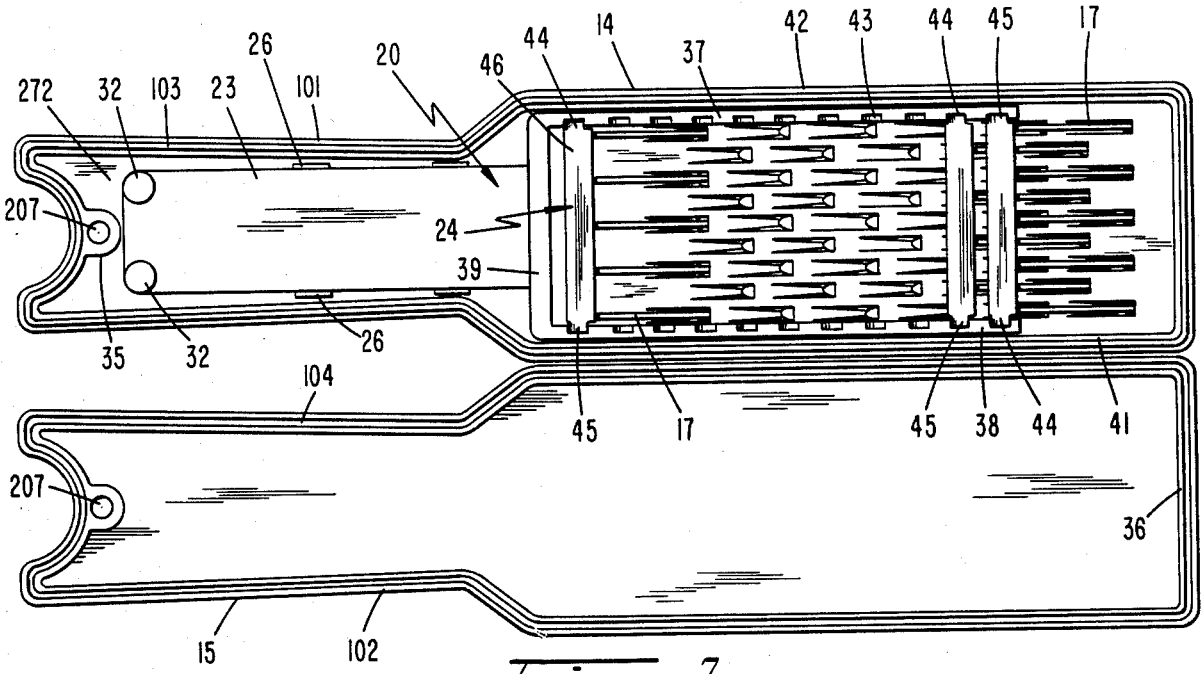
FIG. 2 is a bottom view of the brush illustrated in FIG. 1, with the bottom wall removed and only three bristle bars in place.
Figure 3:
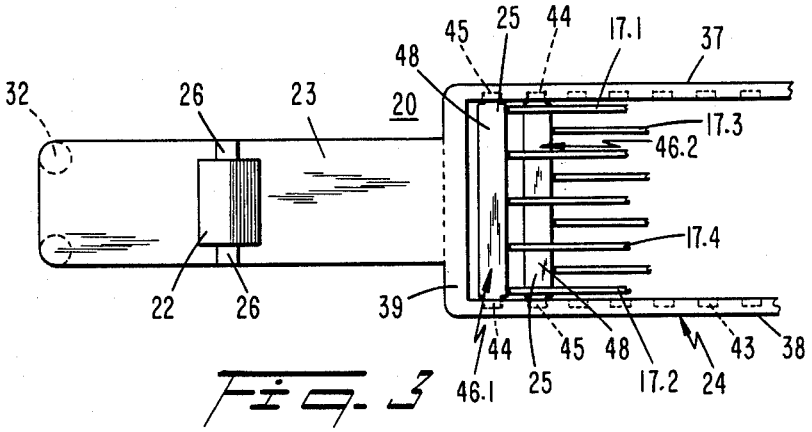
FIG. 3 is a partial top view of the brush illustrated in FIG. 1, with the top removed.

Handle 12 includes an elongated slot 21 for receiving thumb actuated, triangular wedge 22, integrally formed with elastic, downwardly deflectable tongue 23, made of a spring like material, that is preferably plastic. Tongue 23 is a part of slide bar 20 (FIG. 3) that also includes frame 24 for receiving rotatable bristle bars 25 (FIGS. 3, 4 and 5) on which bristle tufts 17 are fixedly mounted. Integrally formed with tongue 23 and extending in the same direction from the tongue as wedge 22, in alignment with the wedge, are rectangularly shaped detent bars 26. Detent bars 26 are normally received in rectangular notches 27 and 28 on interior face 29 of upper cover half 14 while bristle tufts 17 are respectively in the retracted and extended positions. As seen in FIGS. 1, 2 and 3, detent bars 26 extend beyond the vertical walls of slot 21. Detent bars 26 are located in interior cavity 272 formed in handle 12 between interior faces 29 and 30 of cover halves 14 and 15 so that the detent bar is captured in the cavity between the interior walls.

Extending downwardly, i.e., in a direction opposite to that of wedge 22, from the end of tongue 23 remote from frame 24 are spaced feet 32 which engage face 31 of cover half 15. The apex of triangular wedge 22 extends slightly above exterior face 18 of cover half 14 when detent bars 26 are in notches 27 and 28 to facilitate gripping of the wedge by the thumb of a user when the brush is initially activated from the retracted to the extended positions, and vice versa. Slot 21 includes sloping end walls 33 and 34 respectively adjacent notches 27 and 28 to facilitate activation of the brush from the retracted to the extended position and vice versa.

Figure 4:
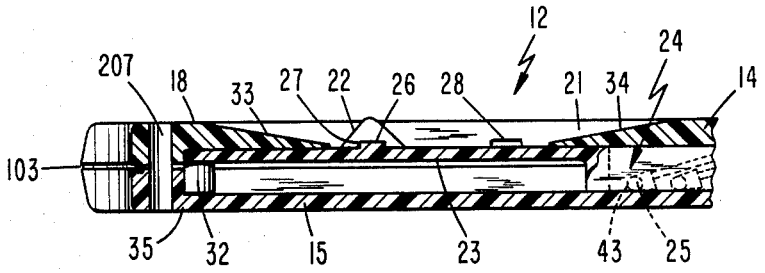
FIG. 4 is a side sectional view of the handle and a portion of the brush segment of the brush illustrated in FIG. 1, wherein the bristle bars are in a retracted, locked position.
Figure 5:
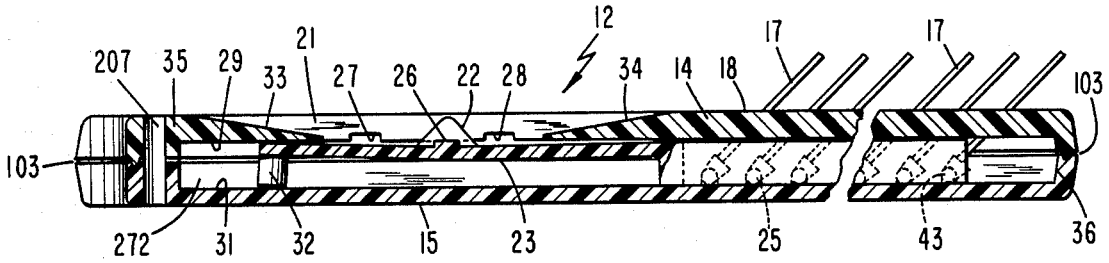
FIG. 5 is a view similar to that of FIG. 4, wherein the bristle bars are rotated to approximately 45°.

In operation, tongue 23 is translated so that detent bars 26 move from notch 27 to notch 28. Initially, wedge 22 is depressed so that detent bars 26 move downwardly out of notch 27. Then wedge 22 is translated to the right, as illustrated in FIGS. 4 and 5. As detent bars 26 are translated between notches 27 and 28, FIG. 5, the spring action of tongue 23 urges the top of the detent bars upwardly to slidably engage face 29. Simultaneously with bars 26 engaging face 29, the bottoms of feet 32 remain in contact with face 31 to provide simple yet stable motion to frame 24, as well as stable and smooth rotary motion of bristle bars 25 and bristle tufts 17 until the detent bars engage the detent notch toward which it is being driven.

To assist in controlling the motion of frame 24, stop 35 is provided at the end of handle 12 remote from the frame. Stop 35 is formed as hollow posts in top and bottom halves 14 and 15. The posts forming stop 35 include passage 207 for receiving tether 273 if desired. Tether 273 can be formed of a leather strap or other similar string like object which fits through passage 207. To locate stop 35 most conveniently, the ends of handle portions 13 of upper and lower casing halves 14 and 15 are formed as semicircles having centers at the intersection of the exterior edges of the ends of the handle segment and the center line of the casing. The edge of frame 24 remote from tongue 23 abuts against wall 36 (FIGS. 2 and 5) in chamber or cavity 272 between faces 29 and 30 when bristle tufts 17 are in a completely extended position, with bar 26 engaging notch 28. Thereby, posts 35 and wall 36 form stops for frame 24 in the retracted and extended positions of the frame.

Frame 24 includes longitudinally extending parallel side walls 37 and 38, joined together by cross piece 39 to which tongue 23 is fixedly attached. Upper casing half 14 includes downwardly depending flanges 41 and 42 having interior faces against which exterior faces of side walls 37 and 38 slideably abut.

Figure 13:
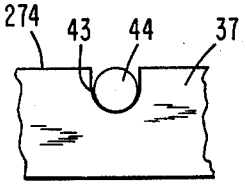
FIG. 13 is an enlarged side view of a dowel fitting into a notch on a sliding frame carrying the bristle bars.

Side walls 37 and 38 include longitudinally aligned notches 43, each having a semicircular base and straight, parallel vertically extending sides, as illustrated in FIG. 13. In the illustrated embodiment, ten notches 43 are provided on each of side walls 37 and 38. Notches 43 receive opposite circular dowels 44 and 45 at the ends of bristle bars 46 (for convenience all of the bristle bars in general bear reference numeral 46, while the even and odd numbered bristle bar rows respectively bear reference numerals 46.1 and 46.2). The diameters of dowels 44 and of the semicircular bases of notches 43 are such that the dowels are completely captured in the notches and do not extend above top face 274 of side walls 37 and 38. Fixedly mounted at spaced locations across bristle bars 46 between dowels 44 and 45 are bristle tufts 17, each formed of a single tapered, unifilar generally straight element. All of elements 17 have parallel longitudinally extending axes. In the illustrated embodiment, five bristle elements 17 are mounted on half of bristle bars 46, while four bristle elements 17 are mounted on the other half of bristle bars 46. Bristle tuft elements 17 are arranged so they engage corresponding slots in matrix 16. Thus, the spacing and topography of the engagement locations of tuft elements 17 and bristle bars 46 are identical to those of the slots in matrix 16. Bristle bars 46 and tuft elements 17 are preferably molded unitary plastic structures.

Figure 14:
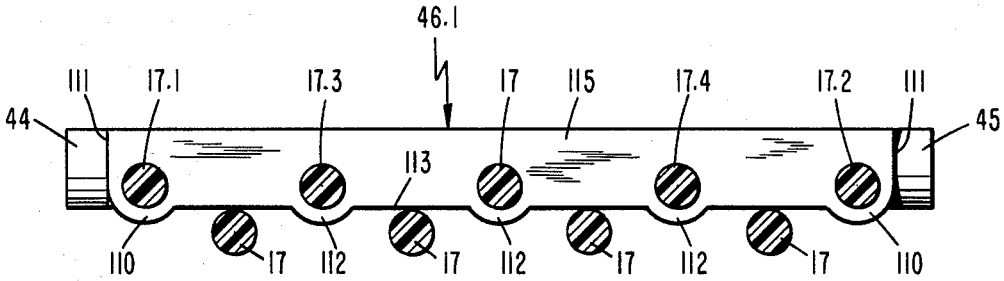
FIGS. 14 and 15 are front views of bristle bars in even and odd numbered rows of the sliding frame, respectively.
Figure 15:
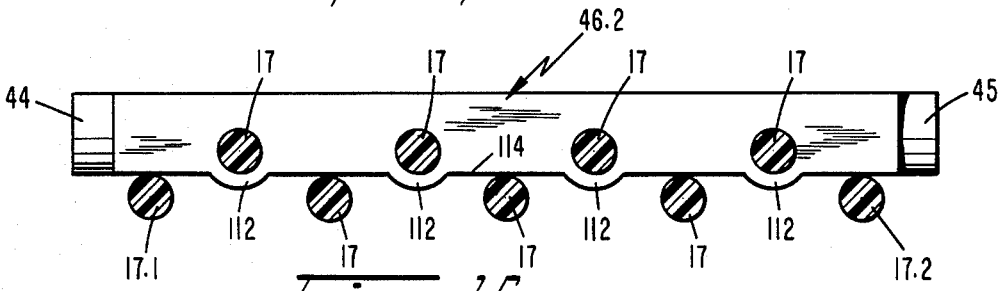

Bristle bars 46.1 in the odd numbered rows are configured differently from bristle bars 46.2 in the even numbered rows. Bristle bars 46.1 include five bristle tuft elements 17, while bristle bars 46.2 include four bristle tuft elements 17. As illustrated in FIGS. 14 and 15, the longitudinal axes of bristle tuft elements 17 in the interior of bristle bars 46.1 are spaced from each other by the same amount, which is equal to the spacing between the longitudinal axes of all of the bristle tuft elements 17 of bristle bar 46.2 (for convenience, individual bristle tuft elements bear reference numerals 17.1, 17.2, 17.3 and 17.4, etc., while the elements in general bear reference numeral 17). The longitudinal axes of bristle tuft elements 17.1 and 17.2 at the ends of bristle bars 46.1 are closer to the longitudinal axes of the adjacent, interior bristle tuft elements 17.3 and 17.4 of bristle bar 46.1 than the spacing between the remaining bristle elements 17 of bars 46.1 and 46.2. Thereby, slightly rounded Bristle shoulders 110 are between the perimeters of bristle tuft elements 17.1 and 17.2 and edges 111 of bristle bar 46.1 A similar rounded shoulder 112 is provided between the perimeter of the remaining bristle elements 17 on bars 46.1 and 46.2 and the adjacent edges 113 and 114 of bristle bars 46.1 and 46.2. Shoulders 110 and 112 facilitate molding of bristles 17 with bristle bars 46.

The tapered geometry of bristles 17 and the interleaved relationship of bristles 17 on adjacent bristle bars 46.1 and 46.2 enable simultaneous rotation of all of bristle bars 46 and bristles 17 without interference between the bristles as they rotate. The taper of bristles 17 in a preferred embodiment is such that the bristles have a diameter of 80 mils at the bases thereof at the intersection thereof with bristle bars 46 and a diameter of 46 mils at the tips of the bristles, where they are rounded. Bristles 17 have a straight contour between the base and tip thereof, when viewed in cross-section. In the preferred embodiment, the space between the longitudinal axes of interior bristle elements 17 of bristle bars 46.1 and all of the bristle elements of bristle bars 46.2 is 300 mils. The longitudinal axes of bristle elements 17 on bristle bar 46 are spaced from the longitudinal axes of the interior bristle elements of bristle bars 46.1 by 150 mils. In contrast, the spacing between the longitudinal axes of exterior bristle elements 17.1 and 17.2 from the longitudinal axes of the exterior bristle elements on bristle bars 46.2 is 133 mils. In the preferred embodiment, each of bristle elements 17 has a length of approximately $1\frac{3}{8}$'s inches from the end of the rounded tip to the intersection of the bristle element with bristle bar 46 on which it is mounted.

Each of bristle bars 46 includes an arbor 115, having opposite edges 111 from which dowels 44 and 45 protrude. Bristles 17 are mounted on arbor 115 so that the longitudinal axes of the bristles are off-set from rotational axes 116 of dowels 45 and 46. Such a construction facilitates rotation of bristles 17 between the retracted and extended positions as slide bar 20 is translated because it minimizes contact between arbor 115 of one bristle bar and bristle element 17 of the adjacent bristle bar. As illustrated in FIGS. 14 and 15, the relationship between the longitudinal axes of bristles 17 and pivot axes 116, as well as the tapers and diameters of bristles 17, are such that bristles 17 of adjacent bristle bars pass slightly below surfaces 113 and 114 of bristle bars 46.1 and 46.2, between shoulders 112. Thus, for example, bristles 17 of the bristle bar 46.2 adjacent bristle bar 46.1 extend slightly beneath face 113 of bristle bar 46.1, between shoulders 112 thereof; bristles 17 of bristle bar 46.1 extend slightly below face 114 of bristle bar 46.2 between shoulders 112.

Detailed consideration is now given, by reference to FIGS. 6–8, 10 and 11, to the construction of notches 27 and 28 as well as slots 124 in matrix 16, and to the relative positioning and operation of bristle tufts 17 in response to translation of detent bar 26 between the retracted and extended positions. As illustrated in FIG. 6, case half 15 includes an interior face 121, parallel to interior face 109 of case half 14 in which matrix 16 is formed. Case half 14 includes exterior face 18, parallel to faces 109 and 121. Bristle bars 46 are positioned in cavity 123 between faces 109 and 121 so that dowels 45 abut against face 121. Pivot axes 116 of adjacent dowels 45 are spaced from each other, in the preferred embodiment by 0.3125 inches, along the length of wall 15.

Each slot 124 in matrix 16 includes, in cross-section, generally straight opposite contours 125 and 126, respectively referred to as leading and trailing contours of the slot. Contours 125 and 126 are defined by straight lines which, in the preferred embodiment, deviate from wall 109 by angles of approximately 10° and 20°, respectively. Contour 126 intersects face 109 along straight line 227, FIG. 10. Between intersection line 227 and contour 125, subsists triangular wedge 127, having a hypotenuse 128, which is inclined at approximately 3° relative to face 109. At the end of elongated contour 126 remote from intersection 227, is a vertically extending, semicircular (in horizontal cross section) wall 134 which meets contour 126 at intersection 131. Straight edges 135 and 136 on opposite sides of slot 124 subsist between straight line intersection 137 of contour 125 and hypotenuse 128 and diametrically opposite edges 132 and 133 of wall 129 along intersection 131. In the preferred embodiment, edges 135 and 136 are inclined from face 109 by an angle of approximately 68°. Walls 135 and 136 are respectively flared outwardly from edges 132 and 133 until they meet edge 137. Along face 18, the flared relationship of slot 124 continues, as defined by edges 138 and 139, FIG. 11.

In face 18, slot 124 has longitudinally extending parallel edges 241 and 242 which respectively intersect edges 138 and 139. Edges 241 and 242 continue to the end of slot 124, at edge 143. Between edge 143 and wall 125 subsists wall 144, which is inclined relative to faces 109 and 18 by a 45° angle. The spacing between edges 227 and 137 of a particular slot is identical to the spacing between pivot axes 116 of dowels 45 of adjacent bristle bars 46. Thus, since adjacent bristle bars in the preferred embodiment have axes spaced from each other by 0.3125 inches, there is a spacing of 0.3125 inches between edges 227 and each of edges 132 and 133.

The longitudinal axes 141 of each of bristle tufts 107 are displaced from face 109 and pivot axes 116 of bristle bars 46 are positioned so that region 142 of bristle tuft 17 engages intersection 227 between wall 126 and face 109 when bristle bar 20 is in the fully retracted position; see FIG. 6. In the preferred embodiment, such a result is achieved by inclining longitudinal axis 141 at an angle of 15° relative to face 109. The longitudinal axes 141 of bristles 17 can be offset approximately 13°-20° relative to face 109 to achieve the desired thinness of case 11 and proper operation of the brushes. Contours 125 and 126 deviate from the offset of axes 141 by −5° and +5°, respectively. Bristle 17 has a length and axis 116 is positioned when bristle bar 20 is in the fully retracted location such that the tip of the bristle is wholly within slot 124 between face 18 and contour 125. Intersection 227 cams regions 142 away from face 18 and toward face 121. Such camming action helps to hold bristle 17 in place so that the tip of the bristle remains in the slot between face 18 and wall 125. Except for the engagement between region 142 and intersection 227 no part of bristle 17 engages any surface of slot 124, to facilitate movement of bristle 17 in the slot in response to translation of bristle bar 20. The spacing and positioning of the walls forming slot 124 are such that if the tip of bristle 17 includes spherical enlargement 107, as illustrated in FIG. 9, no portion of the bristle engages any wall of the slot and the entire bristle is maintained in the slot.

In the preferred embodiment, the separation between the tip of bristles 17 and face 18 is 1-1/16th of an inch and the thickness of casing half 14 between faces 109 and 18 is 0.1875 inches. The thickness of casing half 15 between the parallel walls thereof is 1/10th of an inch. The thickness of cavity of 123 between faces 109 and 121 is 0.2650 inches. The intersection between walls 125 and 144 is spaced from face 18 by 0.0700 inches. The length of wall 140 is 0.020 inches. The spacing between the parallel longitudinal edges of adjacent slots 124 is 0.0400 inches. Each slot has a width between the parallel edges thereof of 0.110 inches. The distance between edge 143 and wall 129 along the perpendicular bisector of each slot is 0.0620 inches while the height of wall 129 from face 18 to intersection 131 is 0.0850 inches.

Figure 8:
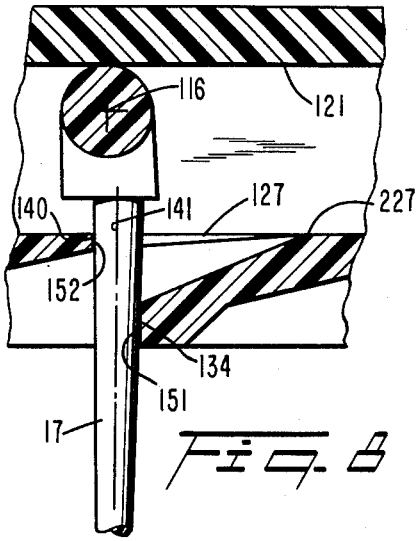
FIG. 8 is a view similar to that of FIG. 6 wherein the bristles are rotated through approximately 90°, to a fully extended position.
Figure 9:
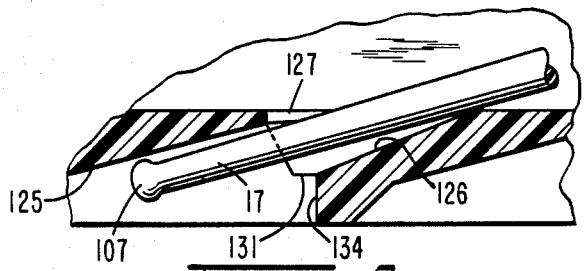

In response to slide bar 20 being translated from the retracted to the fully extended position, dowels 45 are translated to the left and rotated in a counter clockwise direction from the position illustrated in FIG. 6 to the position illustrated in FIG. 8. When slide bar 20 reaches the fully extended position, as illustrated in FIG. 8, the longitudinal axes 141 of bristles 17 are at right angles to faces 109 and 18. Pivot axis 116 is translated beyond longitudinal axis 141. Bristle 17 substantially fills a cylindrical like opening at right angles to and between faces 109 and 18. The cylindrical like opening is defined by semicircular wall 134 (FIGS. 10 and 11) between edge or intersection 131 and the plane of face 18, as well as straight, vertical wall 140 between edge 137 at the intersection of walls 125 and 128 and face 109. Curved region 151 of bristles 17 on the side of longitudinal bristle axis 141 remote from pivot axis 116 engages wall 134 and is confined thereby. Because opposite edges 151 and 152 of bristle 17 engage walls 140 and 134 and because of the off-set position of axis 116 relative to axis 141, bristle 17 is maintained in place as the brush is being used because forces are exerted on diametrically opposite edges 151 and 152 by regions 134 and 140.

Figure 7:
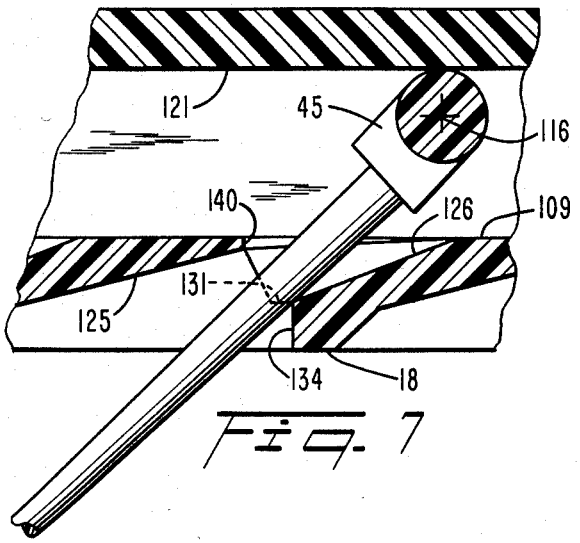
FIG. 7 is a view similar to that of FIG. 6 wherein the bristles are rotated through an angle between the fully retracted and the fully extended position.

As illustrated in FIG. 7 when slide bar 20 has been translated and rotated to an intermediate position from the fully extended to the fully retracted position, a portion of bristle 17 facing face 18 contacts intersection 131 and is cammed upwardly toward faces 109 and 121 as a result of such contact. As slide bar 20 is retracted further, further regions of bristle 17 facing face 18 are dragged across intersection 131 to continue the camming action. As the camming action continues further, longitudinal axis 141 lies in a plane parallel to wall 126, at which time spaced regions along the bottom portion of bristles 17 are in continuous contact with wall 126 that extends between intersections 131 and 227. When slide bar 20 is rotated further to the fully extracted position, the only segment of bristle 17 which remains in contact with slot 124 is region 142 engaging intersection 227. Thereby, the contact between intersection 227 and bristles 17 cams the bristle upwardly toward face 121. When slide bar 20 has been translated so that the bar is in the locked, withdrawn position, bristle 17 is maintained in slot 124, away from face 18 by the camming action of intersection 227 on region 142, as described supra.

While there have been described and illustrated several specific embodiments of the invention, it will be clear that variations in the details of the embodiments specifically illustrated and described may be made without departing from the true spirit and scope of the invention as defined in the appended claims. For example, the dimensions are given for the preferred embodiment and are subject to change.

I claim:

1. A folding brush comprising a case having parallel first and second walls respectively having first and second interior faces spaced from each other to form a cavity, the first wall including a matrix of cylindrical like slots extending between the first face and a third face on the exterior of the first wall, a frame slidable along a longitudinal axis in the cavity between a first retracted position and a second fully extended position, means for locking the frame in the first and second positions, a multiplicity of generally straight bristle tufts each having a tip, base and longitudinal axis, means for mounting the bases of the bristle tufts in the frame so the longitudinal axes of the tufts rotate together from a first retracted angle displaced slightly from the frame longitudinal axis to a second fully extended angle approximately at right angles to the frame longitudinal axis in response to the frame sliding between the first and second longitudinal positions, the bristle tufts being positioned on the frame and the matrix of slots being arranged so that each of the bristle tufts is in a separate one of the slots, the slots being terminated so a generally cylindrical open region subsists between the first and third faces at right angles to the frame longitudinal axis, each open region having an axis substantially coincident with the longitudinal axis of each tuft and having a perimeter such that the tufts substantially fill the open regions while the tufts are rotated to the angle approximately at right angles to the frame longitudinal axis; the first angle, the geometry of the slots, the lengths of the tufts and the spacing between the first and third faces being such that when the bristles are in the retracted position a region on each tuft is cammed by an edge of the slot to maintain the tuft in situ in the slot so the tip of the tuft is in the slot with no portion of the tip extending beyond the third face.

2. The brush of claim 1 wherein each tuft is a tapered unifilar element having a smaller cross section of the tip thereof than at the base thereof, each unifilar element, the first and third faces and each slot being arranged so that when the bristles are in the retracted position a region on the element bears against an intersection between the first face and the slot in which the element is located so the region is cammed by the intersection towards the second face to maintain the portion of the element between the region and the tip displaced from walls of the slot.

3. The folding brush of claim 2 wherein the element is cammed by the intersection such that all segments of the element between the region and the tip are displaced from walls of the slot.

4. The folding brush of claim 3 wherein the region faces toward the third face and is cammed by the intersection away from the third face toward the second face.

5. The folding brush of claim 4 wherein the slot includes an interior edge against which a region of the element is cammed only as the tufts are being translated between the fully retracted and fully extended positions.

6. The folding brush of claim 2 wherein the region faces toward the third face and is cammed by the intersection away from the third face toward the second face.

7. The folding brush of claim 2 wherein the slot includes an interior edge against which a region of the element is cammed only as the tufts are being translated between the fully retracted and fully extended positions.

8. The folding brush of claim 2 wherein a spherical like protuburance is at the tip of each element.

9. The folding brush of claim 2 wherein the longitudinal axis of each element is displaced from the faces by an angle in the range between 13° and 20° and each slot includes opposite leading and trailing contours respectively displaced by about 5° in opposite directions from the longitudinal axis of each element.

10. The folding brush of claim 1 wherein the longitudinal axis of each tuft is displaced from the faces by an angle in the range between 13° and 20° and each slot includes opposite leading and trailing contours respectively displaced by about 5° in opposite directions from the longitudinal axis of each tuft.

11. The folding brush of claim 2 further including a slidable tongue having a first end fixedly connected to the frame, a second end of the tongue including feet means engaging one of the cavity faces, the locking means including: a detent bar on the tongue for engaging first and second longitudinally spaced notches in the second face of the cavity when the frame is respectively in the retracted and fully extended positions, the tongue being made of a flexible spring like material so the portion of the tongue between the ends thereof can be pressed into the cavity and the top of the detent bar is urged against the second face of the handle cavity while the detent bar is between the notches.

12. The folding brush of claim 1 further including a slidable tongue having a first end fixedly connected to the frame, a second end of the tongue including feet means engaging one of the cavity faces, the locking means including: a detent bar on the tongue for engaging first and second longitudinally spaced notches in the second face of the cavity when the frame is respectively in the retracted and fully extended positions, the tongue being made of a flexible spring like material so the portion of the tongue between the ends thereof can be pressed into the cavity and the top of the detent bar is urged against the second face of the handle cavity while the detent bar is between the notches.

13. A folding brush comprising a case having parallel first and second walls respectively having first and second interior faces spaced from each other to form a cavity, the first wall including a matrix of cylindrical like slots extending between the first face and a third face on the exterior of the first wall, a frame slidable along a longitudinal axis in the cavity between a first retracted position and a second fully extended position, means for locking the frame in the first and second positions, a multiplicity of bristle tufts each having a longitudinal axis, means for mounting the bristle tufts on the frame so the longitudinal axes of the tufts rotate together from a first retracted angle displaced slightly from the frame longitudinal axis to a second fully extended angle approximately at right angles to the frame longitudinal axis in response to the frame sliding between the first and second longitudinal positions, the bristle tufts being positioned on the frame and the matrix of slots being arranged so that each of the bristle tufts is in a separate one of the slots, a slidable tongue having a first end fixedly connected to the frame located in the cavity, a second end of the tongue including feet means engaging one of the cavity faces, the locking means including: a detent bar on the tongue for engaging first and second longitudinal spaced notches in the second face of the handle cavity when the frame is respectively in the retracted and fully extended positions, the tongue being made of a flexible spring like material so the portion of the tongue between the ends thereof can be pressed into the cavity and the top of the detent bar is urged against the second face of the handle cavity while the detent bar is between the notches.

14. The brush of claim 13 wherein the handle includes a longitudinal slot between the second face and an exterior face of the casing, the tongue including a segment extending through the handle slot, the detent bar extending on opposite sides of the handle slot.

15. The brush of claim 14 wherein the tongue segment is shaped as a wedge extending slightly beyond the exterior casing face, the handle slot including tapered sides between the casing exterior face and the second face to facilitate manual sliding of the tongue between the retracted and fully extended positions.

16. The brush of claim 13 wherein the case has a bristle portion and a handle, the handle extending longitudinally from the bristle portion, the handle and bristle portion including common parallel first and second walls respectively forming the first and second interior faces.

* * * * *

UNITED STATES PATENT AND TRADEMARK OFFICE

CERTIFICATE OF CORRECTION

PATENT NO. : 4,498,211

DATED : February 12, 1985

INVENTOR(S) : Gary BOTTOLFSON

It is certified that error appears in the above-identified patent and that said Letters Patent is hereby corrected as shown below:

Column 1, line 62, change "expanded" to --extended--.

Column 5, line 22, change "Fig. 12" to --Fig. 2--.

Column 7, line 45, change "Bristles" to --bristles--.

Column 11, line 63, change "second" to --first--.

Column 12, line 2, change "second" to --first--.

Column 12, line 10, change "second" to --first--.

Column 12, line 15, change "second" to --first--.

Column 12, line 42, change "second" to --first--.

Column 12, line 43, change "second" to --first--.

Column 12, line 47, change "second" to --first--.

Column 12, line 50, change "second" to --first--.

Signed and Sealed this

First Day of September, 1987

*Attest:*

*Attesting Officer*

DONALD J. QUIGG

*Commissioner of Patents and Trademarks*